US005187905A

United States Patent [19]

Pourtau et al.

[11] Patent Number: 5,187,905

[45] Date of Patent: Feb. 23, 1993

[54] COMPLEX SOUND-INSULATING MATERIAL AND FLOORING

[75] Inventors: Jean-Jacques Pourtau; Thierry E. Pourtau, both of Croissy sur Seine, France

[73] Assignee: Tomecanic, Aubergenville, France

[21] Appl. No.: 677,138

[22] Filed: Mar. 29, 1991

[30] Foreign Application Priority Data

Apr. 2, 1990 [FR] France ..... 0 04199

[51] Int. Cl.[5] ..... E04B 1/82

[52] U.S. Cl. ..... 52/144; 52/309.4; 52/612

[58] Field of Search ..... 52/144, 145, 309.8, 52/309.4, 309.9, 612, 516

[56] References Cited

U.S. PATENT DOCUMENTS

| | | | |
|---|---|---|---|
| 3,266,206 | 8/1966 | Cosby et al. | 52/309.9 |
| 3,282,008 | 11/1968 | Sheahan | 52/309.9 |
| 3,455,076 | 7/1969 | Clarvoe | 52/309.6 |
| 3,666,606 | 5/1972 | Stokes | 52/309.9 |
| 3,724,152 | 4/1973 | Castellarin | 52/612 |
| 4,685,259 | 8/1987 | Eberhart et al. | 52/144 |

*Primary Examiner*—James L. Ridgill, Jr.
*Attorney, Agent, or Firm*—Lawrence M. Nawrocki

[57] ABSTRACT

This invention relates to a complex sound-insulating material comprising a first lower sub-assembly, itself comprising at least one layer of a bituminous product, and a second upper layer which covers said first sub-assembly. The first sub-assembly comprises a first upper layer, a first intermediate layer and a first lower layer, whilst a) each of the first upper and lower layers is made of oxidized bitumen reinforced with first fibers and has a surface mass of between 500 and 1000 g/m$^2$; b) the first intermediate layer is made of an organic binding agent, such as a bitumen, and by second fibers which are embedded in said binding agent and are in a non-woven form; and c) the second upper layer is made of an elastic foam.

One application of the invention is the production of a sound-insulated tiled flooring.

47 Claims, 1 Drawing Sheet

COMPLEX SOUND-INSULATING MATERIAL AND FLOORING

FIELD OF THE INVENTION

The present invention relates to a complex sound-insulating material and to a flooring employing same.

The domain of the invention is that of the sound-insulation of buildings, and more particularly of the sound-insulation of floors, particularly with respect to impact sounds.

BACKGROUND OF THE INVENTION

Multi-layer complex materials have already been proposed for effecting this type of sound-insulation, but are most often inefficient. It should, moreover, be noted that the solution is far from being obvious, as the total thickness available to the man skilled in the art for making a floor is limited and the thickness available for laying sound-insulating materials is even smaller.

Certain composite materials have a lower layer constituted by an elastic foam and an upper bituminous layer. Others present mortars composed of supple aggregates, most often based on solid rubber. Experience has shown the very low efficiency of these solutions or their low mechanical resistance to shocks, at least when used with the thicknesses compatible with the space available.

The invention proposes a novel type of complex material and a mode of applying this novel complex material, which enable results to be obtained which are considerably better than those obtained heretofore, the general parameters of construction of buildings, particularly concerning the thickness allowed, being, of course, respected.

SUMMARY OF THE INVENTION

The invention therefore firstly relates to a novel complex sound-insulating material of the type comprising a first lower sub-assembly, itself comprising at least one layer of a bituminous product, and a second upper layer which covers said first sub-assembly.

According to the invention, the first sub-assembly comprises a first upper layer, a first intermediate layer and a first lower layer, whilst a) each of the first upper and lower layers is made of oxidized bitumen reinforced with first fibers and has a surface mass of between 500 and 1000 g/m$^2$; b) the first intermediate layer is made of an organic binding agent, such as a bitumen, and by second fibers which are embedded in said binding agent and are in a non-woven form; and c) the second upper layer is made of an elastic foam.

The following advantageous arrangements are in addition preferably adopted in the production of this material:

- said second fibers are glass fibers which each have a thickness of between 50 and 150 microns;
- the thickness of the first intermediate layer is included between 0.05 and 0.5 mm;
- the surface mass of the first intermediate layer is included between 1 and 60 g/m$^2$;
- the dimensional shrinkage rate of each of said first upper and lower layers, within a temperature range of from −40° C. to +80° C., is at the most equal to 0.001 mm;
- the first lower sub-assembly, constituted by said first upper layer, first intermediate layer and first lower layer, has a compressibility at the most equal to 0.5 mm corresponding to a pressure of 0.4 bar;

- said first fibers are glass fibers;
- the surface mass of each of said first upper and lower layers is close, or equal to 700 g/m$^2$;
- the thickness of each of said first upper and lower layers is included between 0.5 and 1.5 mm;
- the outer face of the first lower layer, opposite the face of said first lower layer which is adjacent the first intermediate layer, is coated with a non-stick powder, such as sandstone powder, intended to avoid adherence on one another of said first upper and lower layers during possible superposed storage thereof;
- the surface mass of the second upper layer, corresponding to a thickness of 4 mm, is included between 1.5 kg/m$^2$, and 2.3 kg/m$^2$, and preferably close to 1.9 kg/m$^2$;
- the thickness of the second upper layer is included between 3.2 and 5 mm, and preferably close to 4 mm;
- the second upper layer, of foam, has its upper face defined by a film forming skin, said skin being reinforced by a web of synthetic fibers, preferably made as a non-woven web;
- the foam constituting the second upper layer is a latex foam;
- the coefficient of sound insulation of the second upper layer to shocks, for a thickness of 4 mm, is included between 24 and 30 dB (A), whilst its heat conductivity is included between 0.050 and 0.075 W/m.°C.

The assembly of the first sub-assembly and of the second upper layer is made in monobloc form during implementation by superposing with lap joints the second upper layer adhering with the aid of a bituminous binding agent on the first sub-assembly.

The invention also relates to a flooring employing a complex material according to one of the definitions hereinabove and which comprises a support such as a concrete slab or a wooden or polystyrene panel support, on which said complex material is fixed by means of a layer of an adhesive bituminous binding agent.

This flooring advantageously presents the following characteristics:

- it comprises a support such as a concrete slab or a wooden panel support, on which a panel of extruded polystyrene, whose density is included between 35 kg/m$^3$ and 53 kg/m$^3$, and preferably close to 44 kg/m$^3$, is fixed with the interposition of a layer of an adhesive bituminous binding agent, said complex material resting, by the lower face of its first sub-assembly, on said panel of extruded polystyrene;
- the thickness of the panel of extruded polystyrene is included between 6 and 9 mm, and preferably close to 7.5 mm;
- the lower face of said panel of extruded polystyrene comprises parallel superficial grooves;
- the heat conductivity of said panel of extruded polystyrene is included between 0.020 and 0.031 W/m.°C.;
- this flooring comprises a third upper layer of a thin fibrous interposition coating directly applied in one sole layer on the upper face forming skin of the second upper layer, this third upper layer having a thickness of between 6 and 30 mm;

the third upper layer has a surface mass of between 250 g/mm/m$^2$ and 2000 g/mm/m$^2$, and preferably close to 1600 g/mm/m$^2$, and is constituted by a mortar of powders of hydraulic binding agents, of resins, of synthetic fibers whose length is included between 4 and 8 mm, and preferably close to 6 mm, and whose diameter is included between 50 and 150 microns, and preferably close to 100 microns;

this flooring comprises an upper covering, such as tiles of a tiling, which is fixed on the third upper layer by means of a fourth layer of a suitable adhesive mortar, said upper covering, such as the tiles of a ceramic tiling, having its joints filled with a special mortar mixed with a latex-based liquid.

The principal advantage of the invention is that builders have available a complex material effectively eliminating the transmissions both of variations in dimensions and of sound between a rigid support and the floor covering that it supports.

In addition, in its most complete form, and still respecting the ranges of thickness allowed, the invention ensures a complementary heat insulation, renders the flooring water-tight, allows total disconnection of the surface flooring from its base support, and, finally, reinforces the existing floors, even old ones in a poor state, so as to give them a good stability, allowing any desired upper covering, such as ceramic tiles, to be laid.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
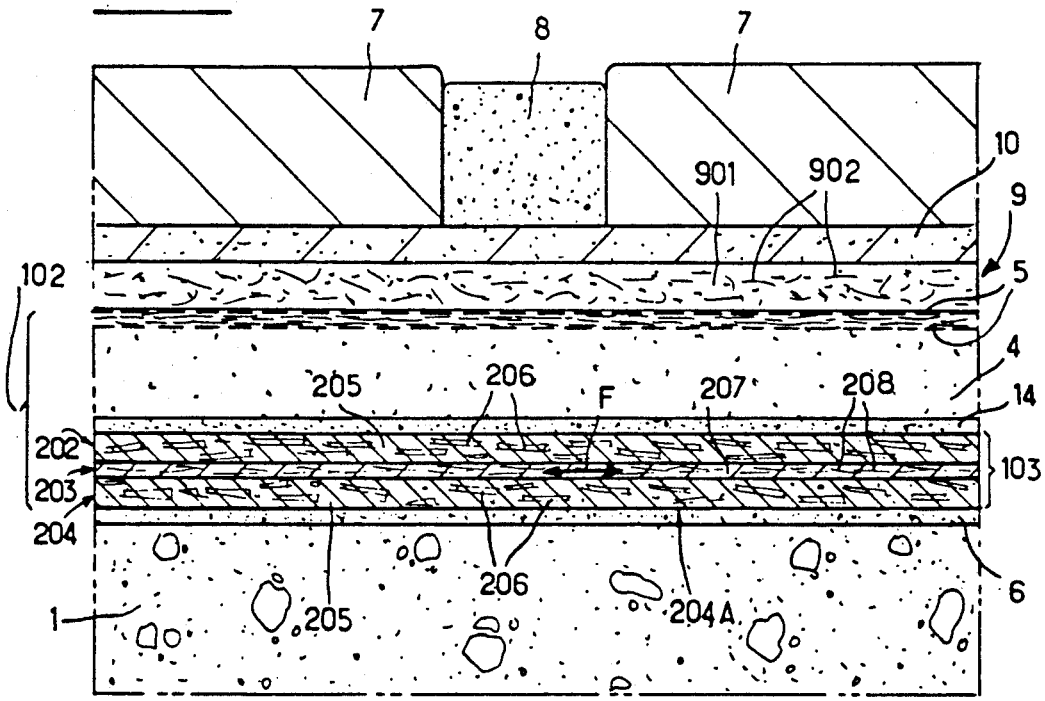
FIG. 1 is a section through a first embodiment of a floor according to the invention.

Referring now to the drawings, the flooring shown in section in FIG. 1 is constituted by:

a lower support 1, such as a slab of concrete, a hardboard panel support, or a steel panel, belonging to the structure of a building;

a material 102, essentially comprising a first lower sub-assembly 103 covered by a second upper layer 4 of an elastic foam, such as a latex foam, the upper face of this second upper layer constituting a sort of skin reinforced by a non-woven web 5 of synthetic fibers;

the assembly of said first lower sub-assembly 103, of the second upper layer 4 and of its skin reinforced with a web 5, constituting the material 102 being, after implementation, in monobloc form, made by adhesion with lap joints of the second upper layer 4 on the first lower sub-assembly 103 with the aid of a layer 14 of an adhesive bituminous binding agent;

a layer 6 of an adhesive bituminous binding agent ensures fixation of the material 103 (more precisely of the lower face of the first lower sub-assembly 103) on the upper face of the support 1;

the tiles 7 of tiling, whose joints are pointed with a special pointing mortar 8 mixed with a liquid containing latex; and a third upper layer 9 of a thin fibrous interposition coating which simultaneously ensures mechanical shock resistance and fixing between the layer 10 of adhesive mortar and the upper face of the web 5 forming skin of the second upper layer 4, the third upper layer 9 being constituted by a mortar 901 reinforced with non-woven synthetic fibers 902.

The first lower sub-assembly 103 comprises a first upper layer 202, a first intermediate layer 203 and a first lower layer 204.

The first upper layer 202 and lower layer 204 are generally similar, approximately of the same composition and of identical dimensions.

In the example shown, these two first upper and lower layers 202 and 204 effectively have the same thickness and the same composition. Each of these first upper layer 202 and first lower layer 204 has the following characteristics:

made of oxidized bitumen 205 within which first fibers 206 are embedded, preferably, and in the example described, constituted by glass fibers;

surface mass of each of the first upper layer 202 and first lower layer 204 included between 500 and 1000 g/m$^2$, preferably equal to 700 g/m$^2$;

virtually total absence of shrinkage between −40° C. and +80° C. (dimensional shrinkage at the most equal to 0.001 mm in the temperature range mentioned);

the first lower sub-assembly 103, constituted by said first upper layer 202, first intermediate layer 203 and first lower layer 204, has a compressibility at the most equal to 0.5 mm corresponding to a pressure of 0.4 bar;

thickness of each of the first upper and lower layers included between 0.5 and 1.5 mm.

The first intermediate layer 203 presents the following characteristics:

made of an organic binding agent 207 such as a malleable bitumen, within which second fibers 208 are embedded, in a non-woven form;

these second fibers 208 are preferably glass fibers;

thickness of a second fiber 208 included between 50 and 150 microns;

thickness of the first intermediate layer 203 included between 0.05 and 0.5 mm;

surface mass of the first intermediate layer 203 included between 1 and 60 g/m$^2$.

Although glass fibers are preferably adopted, it must be indicated that other types of fibers—carbon or even vegetable—may equally well be used.

A fine layer of powder, sandstone in the example described, but more generally a non-stick material, has been sprinkled on the outer face 204A of the first lower layer 204, and thus enables a plurality of sheets of material 103 or 102 to be stacked on one another, or a web of large dimensions of the same sheet may be wound on itself, for storage purposes, avoiding adherence of each sheet on the following. Furthermore, this fine layer of powder has no influence on the possibilities of fixing a sheet of material when making a flooring, as will be observed hereinafter.

Figure 2:
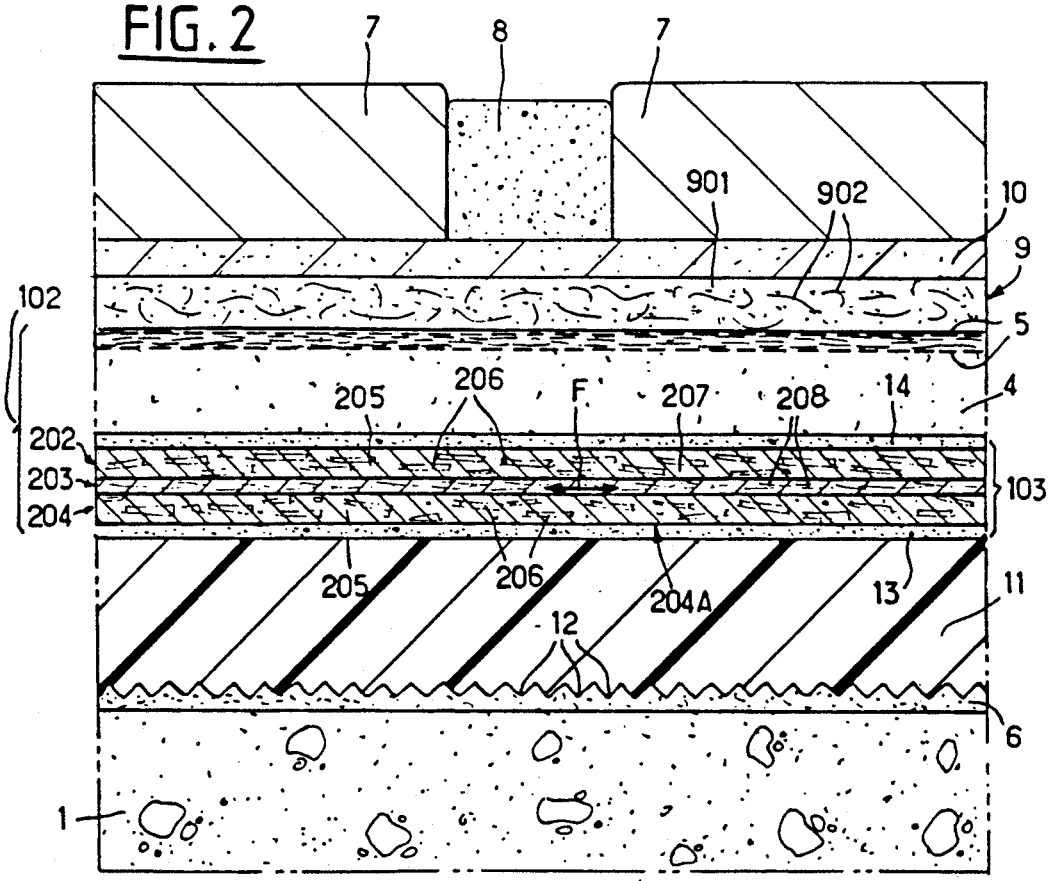
FIG. 2 is a section through a second embodiment of a flooring, likewise according to the invention.

The embodiment of FIG. 2 takes up the same elements as those of the embodiment of FIG. 1, and is completed as follows:

a panel 11, made of extruded polystyrene, is fixed on the support 1 by means of the layer 6 of adhesive bituminous binding agent, its lower face, in order to facilitate clinging of the binding agent, being provided with parallel superficial grooves 12;

the material 103 is fixed on the upper face of said panel by a layer 13 of adhesive bituminous binding agent.

The following indications should be noted:

the thickness of the second upper layer 4 is included between 3.2 and 5 mm, and is preferably close to 4 mm;

the surface mass of the second upper layer 4 is included, for a thickness of 4 mm, between 1.5 and 2.3 kg/m$^2$, and is preferably close, for said thickness of 4 mm, to 1.9 kg/m$^2$;

the coefficient of sound attenuation of the second upper layer 4, for a thickness of 4 mm, is included between 24 and 30 dB (A), and is preferably close to 27 dB (A);

the coefficient of heat conductivity of the second upper layer 4, for a thickness of 4 mm, is included between 0.050 and 0.075 W/m.°C., and is preferably close to 0.062 W/m.°C.;

the thickness of the panel 11 of extruded polystyrene is included between 6 and 9 mm, and is preferably close to 7.5 mm;

the density of the panel 11 of extruded polystyrene is included between 35 and 53 kg/m$^3$, and is preferably close to 44 kg/m$^3$;

the coefficient of heat conductivity of the panel 11 of extruded polystyrene is included between 0.020 and 0.031 W/m.°C., and is preferably close to 0.026 W/m.°C.;

the thickness of the third upper layer 9 of the thin fibrous interposition coating is included between 6 and 30 mm;

the web 5 is composed of a non-woven web of synthetic fibers;

the elements 7 for finishing the flooring, represented as being tiles, may, in a variant, be parquet slats or the like.

Experience has shown that the choice of the various constituents in the ranges of values indicated, and particularly their choice according to the preferred values, leads to a noteworthy efficiency in the domain of sound insulation, particularly with respect to the impact sounds on the flooring in question.

The overall efficiency ascertained may be explained by the following indications:

material 103 firstly constitutes a good insulant between the support 1 and the tiles 7 concerning the non-transmission of the thermal expansions or shrinkages of the support 1 to said tiles; in fact, the constitution of the first upper layer 202 and of the first lower layer 204, which are relatively rigid and incompressible, and of the first intermediate layer 203, which is much more malleable, although not subject to crushing in view of the second fibers 208 that it contains, allows a certain relative slide of the first upper layer 202 with respect to the first lower layer 204 (arrow F), parallel to said layers, each of these first upper and lower layers itself remaining unchanged, in addition virtually exempt of heat shrinkage; under these conditions, the possible variations in dimensions of the support 1 consecutive to temperature variations are not transmitted to the tiles 7 and cannot provoke cracks therein;

however, material 102 has, in addition, good sound-insulation characteristics; it already has the characteristics of the multi-layer materials, of which the good aptitude to opposing the propagation of sound waves is known; moreover, the relative hardness of the first lower layer 204 eliminates the risk of establishing a direct bond between the support of this first lower layer and the first upper layer 202, by transpiercing the first intermediate layer 203; the rough parts are stopped by the first lower layer 204, which would not be produced by a simple layer of glass wool, for example;

the first lower sub-assembly 103 therefore traps the rough parts of the surface of its support and thus protects the foam of the second upper layer 4; in addition, it muffles the sounds by stopping a considerable part of the high frequency sounds;

the third upper layer forming the thin fibrous interposition coating 9 ensures a uniform distribution of the load and thus enables a good, regular foundation for laying the tiles 7, whilst simultaneously offering a good mechanical resistance to shocks;

the specific mass of the third upper layer 9 is included between 1250 g/mm/m$^2$ and 2000 g/mm/m$^2$, and is preferably equal to 1600 g/mm/m$^2$;

this third upper layer is constituted by a mortar 901 of powders of hydraulic binding agents, of resins, of synthetic fibers 902 and of specific fillers mixed with water in a proportion of 4 to 5 liters of water for 25 kg of mixtures of powders and synthetic fibers;

said synthetic fibers 902 have lengths of between 4 and 8 mm, preferably close to 6 mm, and diameters included between 50 and 150 microns, preferably close to 100 microns, and, in a preferred embodiment, are made of polypropylene;

the first function of layers 6, 13 and 14 is to produce a good bond between the various elements, without vibratory beatings, and consequently to obtain a good implementation of the material 102; they also have another function, in connection with their noteworthy suppleness: they remain permanently applied on the surfaces with which they are in contact and contribute to rendering the flooring perfectly water-tight;

finally, when it is provided, the panel 11 of extruded polystyrene reinforces the heat insulation of the flooring.

It should further be noted, on the one hand, that the efficiency obtained results from the reinforcement of the properties of the various constituents which, separately, would not enable the overall result observed to be attained, and, on the other hand, that the propagation of the vibratory and acoustic waves is considerably hindered, and the sound insulation noteworthy, due to the various ruptures of transmission and the various changes in phases which are produced upon passage from one constituent to the other.

The invention is not limited to the embodiments described, but, on the contrary, covers all the variants which may be made thereto without departing from its scope nor its spirit.

In particular, the floor covering may be constituted by the tiles 7 of a hard tiling (sandstone tiles), but may equally well be constituted by plastic materials (linoleum or the like) or even by a fitted carpet.

What is claimed is;

1. Complex sound-insulating material comprising a first lower sub-assembly, at least one layer of a bituminous product, and a second upper layer which covers said first lower sub-assembly, wherein said first lower sub-assembly comprises a first upper layer, a first intermediate layer and a first lower layer and a) each of the first upper and first lower layers of the first lower sub-assembly are made of oxidized bitumen reinforced with first fibers and has a surface mass of between 500 and 1000 g/m$^2$;

b) the first intermediate layer of the first lower sub-assembly is made of an inorganic binding agent, such as bitumen, and by second fibers which are embedded in said binding agent and are in a non-woven form;

c) the second upper layer is made of an elastic foam, and the layer of bituminous product adheres the first lower sub-assembly to the second upper layer.

2. The complex material of claim 1, wherein the surface mass of the first intermediate layer is included between 1 and 60 g/m$^2$.

3. The complex material of claim 1, wherein the dimensional shrinkage rate of each of said first upper and lower layers, within a temperature range of from −40° C. to +80° C., is at the most equal to 0.001 mm.

4. The complex material of claim 1, wherein the first lower sub-assembly, constituted by said first upper layer, first intermediate layer and first lower layer, has a compressibility at the most equal to 0.5 mm corresponding to a pressure of 0.4 bar.

5. The complex material of claim 1, wherein said first fibers are glass fibers.

6. The complex material of claim 1, wherein the surface means of each of said first upper and lower layers is closer, or equal to 700 g/m$^2$.

7. The complex material of claim 1, wherein the thickness of each of said first upper and lower layers is included between 0.5 and 1.5 mm.

8. The complex material of claim 1, wherein the outer face of the first lower layer, opposite the face of said first lower layer which is adjacent the first intermediate layer, is coated with a non-stick powder, such as sandstone powder, intended to avoid adherence on one another of said first upper and lower layers during possible superposed storage thereof.

9. The complex material of claim 1, wherein the surface mass of the second upper layer, corresponding to a thickness of 4 mm, is included between 1.5 kg/m$^2$ and 2.3 kg/m$^2$, and preferably close to 1.9 kg/m$^2$.

10. The complex material of claim 1, wherein the thickness of the second upper layer is included between 3.2 and 5 mm, and preferably close to 4 mm .

11. The complex material of claim 1, wherein the foam constituting the second upper layer is a latex foam.

12. The complex material of claim 1, wherein the coefficient of sound insulation of the second upper layer to shocks, for a thickness of 4 mm, is included between 24 and 30 dB (A), whilst its heat conductivity is included between 0.050 and 0.075 W/m.°C.

13. The complex material of claim 1, wherein the assembly of the first sub-assembly and of the second upper layer is made in monobloc form.

14. The complex material of claim 1, wherein the second upper layer, of foam, has its upper face defined by a film forming skin, said skin being reinforced by a web of synthetic fibers.

15. The complex material of claim 14, wherein the web of synthetic fibers is made as a non-woven web.

16. The complex material of claim 1, wherein the thickness of the fist intermediate layer is included between 0.05 and 0.5 mm.

17. The complex material of claim 16, wherein the surface mass of the first intermediate layer is included between 1 and 60 g/m$^2$.

18. The complex material of claim 16, wherein the first lower sub-assembly, constituted by said first upper layer, first intermediate layer and first lower layer, has a compressibility at the most equal to 0.5 mm corresponding to a pressure of 0.4 bar.

19. The complex material of claim 16, wherein said first fibers are glass fibers.

20. The complex material of claim 16, wherein the thickness of each of said first upper and lower layers is included between 0.5 and 1.5 mm.

21. The complex material of claim 16, wherein the thickness of the second upper layer is included between 3.2 and 5 mm, and preferably close to 4 mm.

22. The complex material of claim 16, wherein the assembly of the first sub-assembly and of the second upper layer is made in monobloc form.

23. Flooring employing the complex material of claim 1, wherein it comprises a support such as a concrete slab or a wooden panel support, on which said complex material is fixed by means of a layer of an adhesive bituminous binding agent.

24. The flooring of claim 23, wherein it comprises an upper covering, such as tiles of a tiling, which is fixed on the third upper layer by means of a fourth layer of a suitable adhesive mortar, said upper covering, such as the tiles of a ceramic tiling, having its joints filled with a special mortar mixed with a latex-based liquid.

25. The flooring of claim 23, wherein it comprises a third upper layer of a thin fibrous interposition coating directly applied in one sole layer on the upper face forming skin of the second upper layer, this third upper layer having a thickness of between 6 and 30 mm.

26. The flooring of claim 25, wherein the third upper layer has a surface mass of between 1250 g/mm/m$^2$ and 2000 g/mm/m$^2$, and preferably close to 1600 g/mm/m$^2$, said surface mass being constituted by a mortar of powders of hydraulic binding agents, of resin, of synthetic fibers whose length is included between 4 and 8 mm, and preferably close to 6 mm, and whose diameter is included between 50 and 150 microns, and preferably close to 100 microns.

27. Flooring employing the complex material of claim 1, wherein it comprises a support such as a concrete slab or a wooden panel support, on which a panel of extruded polystyrene, whose density is included between 35 kg/m$^3$ and 53 kg/m$^3$, and preferably close to 44 kg/m$^3$, is fixed with the interposition of a layer of an adhesive bituminous binding agent, said complex material resting, by the lower face of its first sub-assembly, on said panel of extruded polystyrene.

28. The flooring of claim 27, wherein the thickness of the panel of extruded polystyrene is included between 6 and 9 mm, and preferably close to 7.5 mm.

29. The flooring of claim 27, wherein the lower face of said panel of extruded polystyrene comprises parallel superficial grooves.

30. The flooring of claim 27, wherein the heat conductivity of said panel of extruded polystyrene is included between 0.020 and 0.031 W/m.°C.

31. The flooring of claim 27, wherein it comprises an upper covering, such as tiles of a tiling, which is fixed on the third upper layer by means of a fourth layer of a suitable adhesive mortar, said upper covering, such as the tiles of a ceramic tiling, having its joints filled with a special mortar mixed with a latex-based liquid.

32. The flooring of claim 27, wherein it comprises a third upper layer of a thin fibrous interposition coating directly applied in one sole layer on the upper face forming skin of the second upper layer, this third upper layer having a thickness of between 6 and 30 mm.

33. The flooring of claim 32, wherein the third upper layer has a surface mass of between 1250 g/mm/m$^2$ and 2000 g/mm/m$^2$, and preferably close to 1600 g/mm/m$^2$, said surface mass being constituted by a mortar of powders of hydraulic binding agents, of resin, of synthetic fibers whose length is included between 4 and 8 mm, and preferably close to 6 mm, and whose diameter is included between 50 and 150 microns, and preferably close to 100 microns.

34. The complex material of claim 1, wherein said second fibers are glass fibers which each have a thickness of between 50 and 150 microns.

35. The complex material of claim 34, wherein the surface mass of the first intermediate layer is included between 1 and 60 g/m$^2$.

36. The complex material of claim 34, wherein the first lower sub-assembly, constituted by said first upper layer, first intermediate layer and first lower layer, has a compressibility at the most equal to 0.5 mm corresponding to a pressure of 0.4 bar.

37. The complex material of claim 34, wherein said first fibers are glass fibers.

38. The complex material of claim 34, wherein the thickness of each of said first upper and lower layers is included between 0.5 and 1.5 mm.

39. The complex material of claim 31, wherein the thickness of the second upper layer is included between 3.2 and 5 mm, and preferably close to 4 mm.

40. The complex material of claim 34, wherein the assembly of the first sub-assembly and of the second upper layer is made in monobloc form.

41. The complex material of claim 2, wherein the thickness of the first intermediate layer is included between 0.05 and 0.5 mm.

42. The complex material of claim 41, wherein the surface mass of the first intermediate layer is included between 1 and 60 g/m$^2$.

43. The complex material of claim 41, wherein the first lower sub-assembly, constituted by said first upper layer, first intermediate layer and first lower layer, has a compressibility at the most equal to 0.5 mm corresponding to a pressure of 0.4 bar.

44. The complex material of claim 41, wherein said first fibers are glass fibers.

45. The complex material of claim 41, wherein the thickness of each of said first upper and lower layers is included between 0.5 and 1.5 mm.

46. The complex material of claim 41, wherein the thickness of the second upper layer is included between 3.2 and 5 mm, and preferably close to 4 mm.

47. The complex material of claim 41, wherein the assembly of the fist sub-assembly and of the second upper layer is made in monobloc form.

* * * * *